US005901959A

United States Patent [19]

Tessiot

[11] Patent Number: 5,901,959

[45] Date of Patent: May 11, 1999

[54] GROUND TARGET FOR SIMULATING THE HEAT SILHOUETTE OF A VEHICLE SUCH AS A TANK

[75] Inventor: Jean Tessiot, Soye En Septaine, France

[73] Assignee: Etat Francais représenté par de Delegue General pour l'Armement, Paris, France

[21] Appl. No.: 08/928,754

[22] Filed: Sep. 12, 1997

[30] Foreign Application Priority Data

Sep. 12, 1996 [FR] France ..... 96 11126

[51] Int. Cl.[6] ..... F41I 00/00

[52] U.S. Cl. ..... 273/348.1; 273/359

[58] Field of Search ..... 273/348.1, 359, 273/408

[56] References Cited

U.S. PATENT DOCUMENTS

| | | | |
|---|---|---|---|
| 4,240,212 | 12/1980 | Marshall et al. . | |
| 4,253,670 | 3/1981 | Moulton et al. | 273/348.1 |
| 4,515,374 | 5/1985 | Herren, Jr. | 273/359 |
| 4,946,171 | 8/1990 | Merle et al. . | |
| 5,065,032 | 11/1991 | Prosser . | |

FOREIGN PATENT DOCUMENTS

| | | |
|---|---|---|
| 0 156 070 | 10/1985 | European Pat. Off. . |
| 2716962 | 9/1995 | France . |
| 35 16 392 A1 | 11/1986 | Germany . |

*Primary Examiner*—William H. Grieb
*Attorney, Agent, or Firm*—Oliff & Berridge, PLC

[57] ABSTRACT

The invention is a ground target that simulates the heat support structure of a moving object, particularly a vehicle such as a tank. It has adjustable heat transmitter at least partially covering a support structure whose three-dimensional shape resembles that of the object to be represented. The heat transmitter has modular elements which are attached to an intermediate solid structure. The modular elements are plate-shaped diffusors with at least one heater associated with the inside surface of each diffusor. The target can be used for simulation tests with or without actual engagement with training ammunition by training vehicles.

13 Claims, 3 Drawing Sheets

GROUND TARGET FOR SIMULATING THE HEAT SILHOUETTE OF A VEHICLE SUCH AS A TANK

BACKGROUND OF THE INVENTION

The invention relates to a ground target for simulating the heat silhouette of an object, particularly that of a vehicle such as a tank.

In this area, heat targets heated by the Joule effect are known. U.S. Pat. No. 5,065,032 describes a three-dimensional target made of electrically insulating, fire-resistant material, covered in certain spots by a heating coating in order to simulate the heat signature of the tank.

Also, French Patent 2716962 describes a three-dimensional simulation decoy, particularly for a tank, which has a support structure made of assemblable metal elements on which is disposed a camouflage cover and heating means are placed at certain spots in order to simulate the heat signature of the tank.

Moreover, European Patent 156070 describes a device with adjustable heat transmitting means covering at least partially a three-dimensional support structure similar to the shape of the vehicle to be simulated, the heat transmitting means being comprised of modular elements disposed on an intermediate solid structure, the modular elements being plate-shaped diffusors, with at least one heater being associated with the inside surface of each diffusor.

These targets have a number of drawbacks. The first is that either the observer has to move or the target has to be manipulated in a cumbersome manner to allow the target to be observed from several observation angles. Moreover, in the case of the three-dimensional targets of the prior art, infrared radiation reflections are produced between each of the various facets of the target, complicating precise simulation of the infrared signature of the object to be simulated.

Further the heat targets reproduce only a uniform heat silhouette by contrast and do not allow variations over a broad temperature range to be achieved.

SUMMARY OF THE INVENTION

The goal of the invention is to overcome the aforesaid drawbacks by providing a heat target easily observable at different observation angles and allowing more precise simulation of a heat silhouette of an object, particularly a vehicle such as a modern tank whose heat signature contrasts very little with the environment. This simulation can be effected both statically and dynamically, even in uneven terrain.

The invention relates to a device constituting a ground target that simulates the heat silhouette of a moving object, particularly a vehicle such as a tank, characterized by having adjustable heat transmitting means covering at least partially a support structure whose three-dimensional shape resembles that of the object to be represented, with the support structure having a road train.

The road train can, for example, be made of at least two wheel/axle assemblies connected to a chassis. At least two wheels, namely at least one axle, can be steerable wheels.

According to an additional characteristic, the vehicle also has drive means, the latter being, in particular, an internal combustion engine or an electric engine.

According to another characteristic, the heat transmitting means comprise means for simulating the heat silhouette of the road train of the object as well as means for allowing displacement, relative to the support structure, of at least part of the road train heat silhouette simulation means.

According to an additional characteristic, the road train heat silhouette simulation means comprise at least two frames, the first of which simulates the upper part of the road train of the object and is fixed relative to the support structure while the second simulates the lower part of the road train of the object and is displaceable by means able to allow the displacement.

According to one particular characteristic, the means for allowing the displacement comprise at least one actuator of the electric or hydraulic type, for example.

According to another particular characteristic, the heat transmitting means comprise modular elements attached to an intermediate solid structure, whereby the modular elements can in particular be plate-shaped diffusors, at least one heater being associated with the inside surface of each diffusor.

Preferably, the heat transmitting means are controllable, namely regulable according to the heat characteristics of the target environment at a given point in time.

According to another characteristic, the support structure has a base allowing at least part of the intermediate structure to pivot approximately 180 degrees in the horizontal plane.

In one variant, to simulate a tracked vehicle moving on dry, firm ground, the device is additionally characterized by a heating trailer being disposed on each side behind the support structure and resting on the ground in order to simulate tank tracks. This trailer can be fastened behind the support structure and include rolling means.

According to another characteristic, the support structure has means for powering and monitoring the heat transmitting means.

BRIEF DESCRIPTION OF THE DRAWINGS

Other characteristics and advantages of the invention will emerge from the detailed and nonlimiting description hereinbelow of several embodiments with reference to the attached drawings wherein.

DETAILED DESCRIPTION OF PREFERRED EMBODIMENTS

Figure 1:
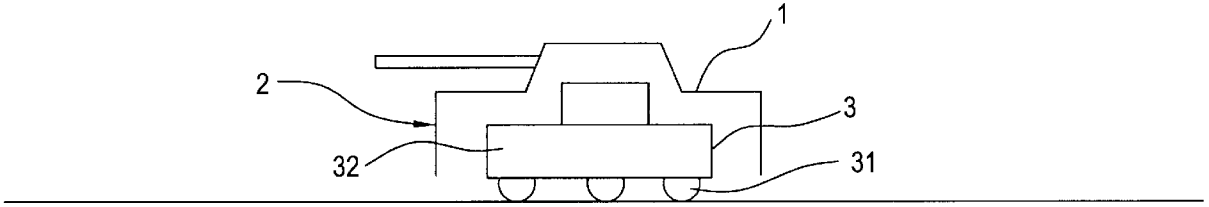
FIG. 1 is a schematic representation of a first embodiment of a moving target.

Heat target 1, shown in FIG. 1, represents a first embodiment used for tests without firing, i.e., a tracking simulator particularly for measuring infrared silhouettes for simulation purposes. It has heat transmitting means 2 and a support structure 3 designed to support the heat transmitting means 2.

As shown in FIG. 1, support structure 3 is a vehicle having a road train 31 composed of three pairs of wheels and an intermediate structure, in this instance a bed 32 on which heat transmitting means 2 are mounted.

Figure 3:
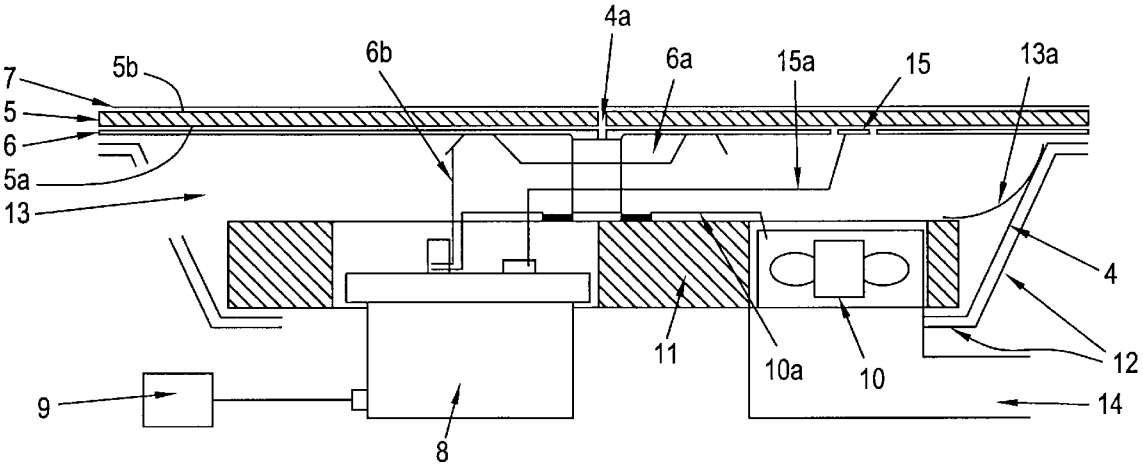
FIG. 3 is a schematic representation of heat transmitting means with which a target according to the invention is equipped.

With reference to FIG. 3, heat transmitting means 2 has two main parts, a solid structure and modular elements constituting a skin.

The solid structure of the bed 32 is comprised of tubes 4 made of composite material, of the contoured fiberglass type for example, for assembling and holding the modular elements. The modular elements are positioned on the solid structure in such a way as to delimit the outline of the vehicle to be represented.

The modular elements are composed of eight main electromechanically homogenous elements corresponding to the various structural or functional parts of the vehicle to be simulated, namely in this example of a tank, a gun, turret, front and rear parts, right and left sides, right and left lower parts.

Each main element is divided into frames, each representing a homogenous electromechanical entity. Each frame is comprised of temperature-regulated facets and nonregulated facets. The number of nonregulated facets of the "mask" type represents only a very small fraction of the surface of the skin in order to create contrast relative to the regulated background facets, and also to simplify the design of the heat transmitting means 2.

However, one facet can belong to two different frames. One thus obtains an image with a heat contrast of as much as 0.5° C., and a realistic representation of individual points and structural details.

Each of the temperature-regulated facets is comprised of diffusors 5 with which heaters 6 are associated. The heaters 6 are glued, or otherwise attached, to the inside surface 5*a* of the diffusors 5. The diffusors 5 are, for example, aluminum sheets approximately 5 mm thick, covered on the outside surface 5*b* with a coat of paint 7 to obtain optical characteristics such as a reflection factor greater than or equal to 0.1 in the visible and near infrared bands as well as emissivity greater than 0.9 in the wavelength range between 8 and 12 $\mu$m for an observation angle of less than 60 degrees. The choice of such a coating reflecting the solar flux reduces the need for continuous cooling to obtain a setpoint.

In addition, the specular reflection factor must be less than 0.1 in the wavelength range of 8 to 12 $\mu$m and for an observation angle less than 85 degrees.

The use of diffusors designed for these factors renders heat exchange between facets by radiation negligible and thus simplifies regulation and hence simulation of the infrared signature of the object.

In addition, taking into account factors only in the wavelength range of 8 to 12 $\mu$m only slightly obscures the signature simulation field and overcomes the drawbacks of the prior art relating to radiation exchanges between facets.

Heaters 6 are, in this preferred embodiment, laminar electrical resistors connected in series by conductors 6*a* and made to adequate dimensions. The dissipatable power density can vary between 2000 W/m$^2$ and 6300 W/m$^2$.

Advantageously, the dimensions of the diffusors 5, which correspond to those of the facets, are small, for example 40 cm by 40 cm maximum, to limit damage on impact of a projectile for a configuration of the device at which munitions are fired, as described below, and to facilitate repairs. In general, the realism of the simulation is enhanced as well, and deterioration of the heat image after impact is limited.

To control the temperature rise of the transmitting means, namely the heat silhouette of the target, each heater is connected to a regulator 8 by connection 6*b*. The regulator 8 is controlled by a command and control unit 9 which is outside the heat transmitting means.

A facet ventilation group 10 is also provided, connected at connection 10*a* to the regulator 8, to ensure cooling of a regulated area, if necessary, in the case of a sharp temperature rise during regulation.

The ventilation group 10 is comprised of fans mounted in a panel 11 made, for example, of a composite material. At 12, the panel rests on solid structure 4. A space 13 of about 20 cm allows air to pass between panel 11 and diffusors 5, and is closed at the rear by a sheet of metal 13*a*, for example, aluminum alloy. The diffusors 5 and heaters 6 are supported by structural shapes 4*a* which themselves rest on panel 11.

The fans operate on an all-or-nothing basis, drawing in and discharging the heated air under the skin by a ventilation duct 14 connected to the outlet of the ventilation group 10. The fans are controlled by regulators 8 connected with control unit 9. Advantageously, at least one regulator 8 is provided per facet so that the power can also be switched for the heaters 6.

A temperature sensor 15 of the "postage stamp" type is glued, or otherwise attached, directly to the inside surface of the diffusors 5 in an area not covered by the heaters 6. The sensor 15 is connected to the regulator 8 by connection 15*a* such that the information supplied by the sensor 15 allows the heaters 6 to be regulated instantly.

The elementary adjustments of regulation and temperature homogeneity are effected at the frame level.

In the first embodiment shown in FIG. 1, the support structure is specific and designed to have dynamic behavior similar to that of the vehicle to be simulated, for example a tank. Thus the support structure 3 is itself a vehicle equipped with a chassis, a drive element, road train, and a cockpit. In order to match the heat silhouette of a tank, which is characterized by a small available height over a large part of the surface, the drive element and the cockpit are disposed under the thickest part corresponding to the turret. In known fashion, the chassis is an assembly of fabricated shapes in order to integrate all the supports of the vehicle's equipment and the supports of the interface with the heat transmitting means.

An internal combustion engine is connected by a transmission shaft to a mechanical distributor that divides the engine power between several hydraulic pumps for propulsion and for generating electricity for the heat transmitting means.

In order to simulate the mobility of the vehicle as closely as possible, the support structure is a vehicle with three axles and six independent wheels. All the wheels are driven by a hydraulic motor of the hub-motor type. Thus, the vehicle is fully hydraulic.

In order for the simulation to be as realistic as possible, the turning radius means that the steering has to be designed for turning the front and rear wheels in any terrain. Thus, the vehicle has four drive wheels.

The cab of the control station is isolated from the rest of the vehicle by a metal enclosure. This enclosure is connected to ground and air-conditioned. The control station has, in known fashion, the classical controls of an automobile.

The outer shell of the support structure 3 is made of polished stainless steel sheet in order to reduce the heat silhouette of the vehicle. On the inside of the vehicle the shells are provided with heat insulation about 2 cm thick with very low thermal conductivity. On the inside of the vehicle, the insulation is covered by a sheet of polished aluminum. The bottom plate of the vehicle is painted on each side with low-emissivity paint.

The hot cooling and exhaust gases from the vehicle are exhausted at its rear through a downwardly tilted grid equipped with upward-pointing deflecting fins. This grid is recessed at the outside of the vehicle so that it is at the same level as the transmitting means of the heat skin.

The fresh air enters at the lower surface in front of the vehicle through all the existing orifices of the heat transmitting means. Some of the air circulates between the diffusors and the solid structure to prevent formation of hot-air pockets. The air is driven through exchangers by four fans driven by hydraulic motors.

The heat transmitting means rest on the support structure 3, the latter supplies the energy and heat control of the diffusors by means of the command and control unit 9 and ensures mobility.

Advantageously, the command and control unit 9 is inserted into the support structure 3 and comprises a PC type computer. The command and control unit 9 is programmed to provide regulation setpoints based on the outside environment and a map in order to control the heaters and pick up temperature data measured by sensors 15. The command and control unit 9 is able to detect any breakdowns in the elements of which the device is composed.

Figure 2:
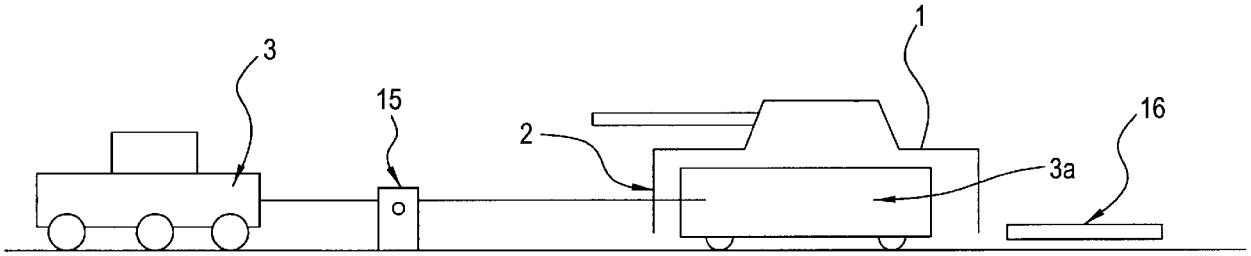
FIG. 2 is a schematic representation of a second embodiment.

In the embodiment shown in FIG. 2, which corresponds to a heat target for tests during which munitions are actually fired at the target, the heat transmitting means 2 rests on a pivoting bed 3*a*.

In this second embodiment, the support structure 3 described above is located remotely in order not to be damaged when fired on. The structure provides energy to the heat transmitting means and ensures thermal control by a network. However, the structure could be independently powered and controlled.

Bed 3*a* is a solid wooden structure that has the same bearing surfaces as the support structure 3 to receive the heat transmitting means 2. The bed 3*a* rests on a rotating base that allows it to rotate approximately 180° relative to the median axis. Rotation is provided by electric motors. It is thus possible to present a different view of the target while the projectile is in flight.

According to one preferred characteristic of the invention, heat transmitting means 2 in the form of modules simulate the road train of the simulated object, in this case the track of a tank, and are in part translationally movable relative to the vehicle chassis.

According to a first embodiment, this mobility is ensured, for each module, by electric or hydraulic actuators attached at one of their ends to the chassis and to the heat transmitting means 2 at the other. Operation of the actuators of one module is independent of that of the other modules.

This mobility of the modules allows the vehicle to drive over an obstacle such as a rock or a bump.

Figure 4:
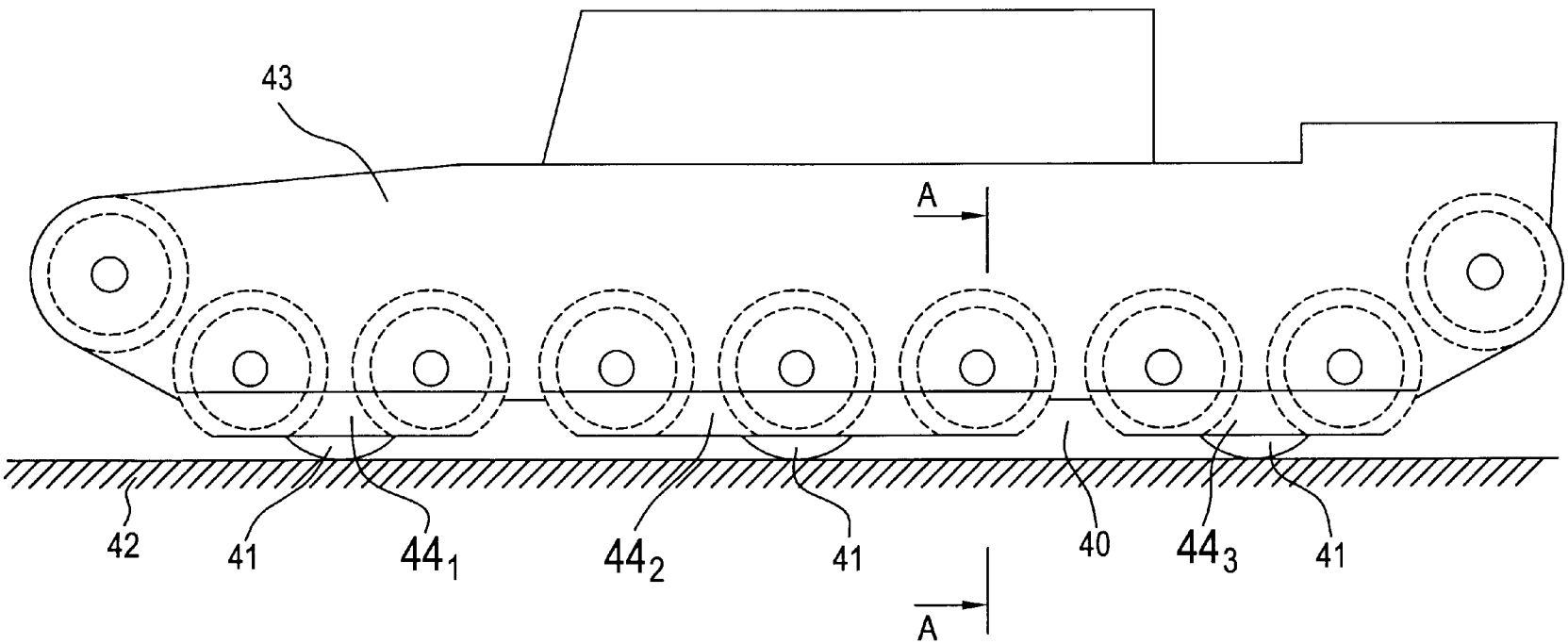
FIG. 4 shows schematically the heat transmitting means that simulates the road train of a tank.
Figure 5:
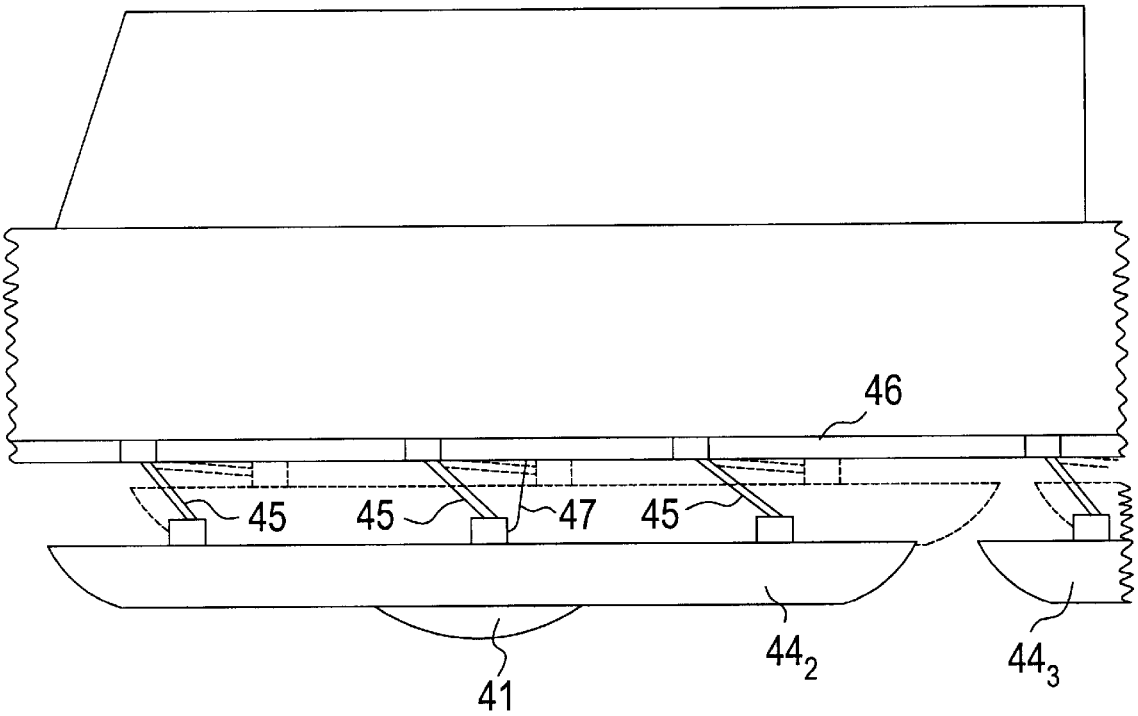
FIG. 5 shows schematically means for displacing the lower frame of the heat transmitting means that simulates the road train.
Figure 6:
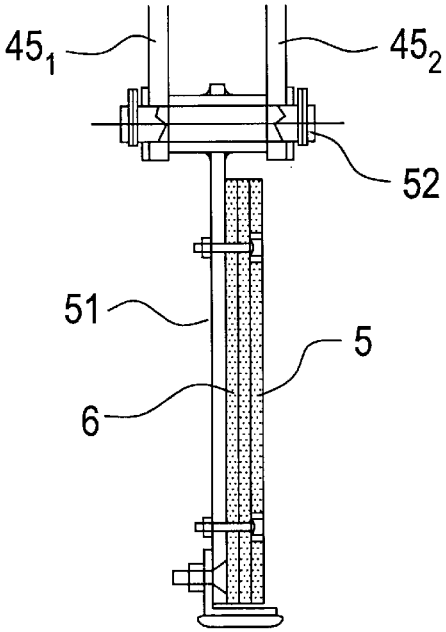
FIG. 6 is a schematic representation of a detail of the displacement means of the lower frame.

According to a second embodiment, shown in FIGS. 4 to 6, heat transmitting means 40 simulate a road train of a tank having, for each track, a plurality of road wheels, a drive wheel, and an idler wheel. The simulated vehicle has six actual drive wheels 41, rolling on ground 42. The heat transmitting means 40 have on one hand a first frame 43 which is fixed relative to the vehicle chassis and has a ground clearance of about ten centimeters. They have on the other hand a set of three road wheels 41 on a side corresponding to a set of three movable frames $\mathbf{44}_1$, $\mathbf{44}_2$, $\mathbf{44}_3$. Simulation of the "tank" road wheels by the heat transmitting means is shown in dashed lines. Thus, as far as the road wheels are concerned, frame 43 simulates approximately two-thirds of the simulated "tank's" road wheels surface area while frames $\mathbf{44}_1$, $\mathbf{44}_2$, $\mathbf{44}_3$ simulate about one-third of the "tank's" road wheels surface area.

As shown in FIG. 5, the mobility of frame $\mathbf{44}_2$, as exemplary of all frames $\mathbf{44}_1$, $\mathbf{44}_2$, $\mathbf{44}_3$, is provided by link rods 45 attached to both chassis 46 and frame $\mathbf{44}_2$. The initial position of the frame $\mathbf{44}_2$ is adjusted by a cable 47.

When it is desired to simulate operation over firm ground into which a tank does not sink, the cable is tensioned such that frames $\mathbf{44}_1$, $\mathbf{44}_2$, and $\mathbf{44}_3$ touch the ground.

When it is desired to simulate operation in mud, the cable is pulled upward so that frames $\mathbf{44}_1$, $\mathbf{44}_2$, $\mathbf{44}_3$ are fully retracted and only the heat transmitting means of frame 43 emits an infrared signature.

The retracted position of frame $\mathbf{44}_2$ is shown in dashed lines in FIG. 5.

Also, to simulate driving over a bump, frames $\mathbf{44}_1$, $\mathbf{44}_2$, $\mathbf{44}_3$ retract one after the other as the bump is driven over, then return to the original positions when they have passed over the bump.

In order to avoid damage to frames $\mathbf{44}_1$, $\mathbf{44}_2$, $\mathbf{44}_3$ when they pass over obstacles, shock absorbers are provided at the front of each frame $\mathbf{44}_1$, $\mathbf{44}_2$, $\mathbf{44}_3$.

FIG. 6 shows in detail the anchor point of a link to frame $\mathbf{44}_2$. Link 45 is comprised of two parallel elements $\mathbf{45}_1$, $\mathbf{45}_2$ having openings that face each other at their lower ends. A lever 51 with a shaft 52 that rotates freely in the openings supports a heater 6 and a diffusor 5.

Moreover, a system of rigid suspensions ensures behavior of the simulated vehicle that is substantially identical to that of a tracked vehicle with respect to roll, pitch, and yaw.

Also, when it is desired to simulate a tracked vehicle that has just come to a halt on dry, solid ground, i.e. ground that does not shift, a heating trailer 16 resting on the ground is disposed on each side behind the device to simulate the tank track. This trailer can, for example, be attached to the support structure 3 or the pivoting bed 3*a*.

A moving target device that allows the firing of dummy projectiles can be designed by interposing a protection impact subassembly between the heat skin or heat transmitting means and the support structure in order to insulate the driver from the device.

The modular nature of the ground target according to the invention will be noted, as well as the fact that it is self-regulatable. Moreover, it is advantageous to be able to memorize the actual displayed map and to have a minimum margin of approximately plus 20% over the apparent temperature of each facet defined on a map.

What is claimed is:

1. A device constituting a ground target to simulate the heat support structure of an object which includes a road train, the device comprising:

a support structure; and adjustable heat transmitting means covering at least partially the support structure and having a three-dimensional shape resembling that of the object to be represented, the heat transmitting means comprises means for simulating the heat silhouette of the road train of the object; and means for allowing displacement of at least part of the road train heat silhouette simulation means relative to the support structure.

2. The device according to claim 1, wherein the road train heat silhouette simulation means comprises at least two frames, a first frame simulating the upper part of the road train of the object and being fixed relative to the support structure and a second frame simulating the lower part of the road train of the object, the second frame having displacement means.

3. The device according to claim 2, wherein the displacement means that allows displacement of at least part of the road train heat simulation means comprises at least one actuator.

4. The device according to claim 2, wherein the displacement means comprises at least one link rod.

5. The device according to claim 1, wherein the heat transmitting means comprises a plurality of modular elements attached to an intermediate solid structure.

6. The device according to claim 5, wherein a shape and dimensions of the modular elements correspond to the various structural or functional parts of the object being simulated.

7. The device according to claim 5, wherein the modular elements comprise a plurality of plate-shaped diffusors, at least one heater being associated with an inside surface of each diffusor.

8. The device according to claim 7, wherein at least one diffusor has a reflection factor greater than or equal to 0.1 in the visible and near infrared bands as well as an emissivity greater than 0.9 in the wavelength range between 8 and 12 $\mu$m and for an observation angle of less than 60 degrees.

9. The device according to claim 7, wherein each diffusor is made of aluminum sheet coated on its outside surface with a coat of paint.

10. The device according to claim 1, wherein the heat transmitting means are controllable.

11. The device according to claim 10, wherein the vehicle has means for powering and controlling the heat transmitting means.

12. The device according to claim 1, for simulating a moving tracked object operating over dry, solid ground, further comprised a heating trailer disposed on each side behind the support structure in order to simulate tank tracks.

13. The device according to claim 1, wherein the support structure has a base allowing an intermediate solid structure mounted thereon and supporting the heat transmitting means to pivot approximately 180 degrees in the horizontal plane.

* * * * *